US009574159B2

(12) United States Patent
Matsubara et al.

(10) Patent No.: US 9,574,159 B2
(45) Date of Patent: Feb. 21, 2017

(54) GREASE COMPOSITION FOR IMAGE FORMING APPARATUS AND IMAGE FORMING APPARATUS WITH GREASE COMPOSITION

(71) Applicants: KYODO YUSHI CO., LTD., Fujisawa-shi, Kanagawa (JP); SEIKO EPSON CORPORATION, Suwa-shi, Nagano (JP); HOSOKAWA CORPORATION, Suwa-shi, Nagano (JP)

(72) Inventors: Kenichiro Matsubara, Shanghai (CN); Masamichi Yamamoto, Fujisawa (JP); Satoshi Nakata, Matsumoto (JP); Koji Hosokawa, Suwa (JP)

(73) Assignees: KYODO YUSHI CO., LTD., Fujisawa (JP); SEIKO EPSON CORPORATION, Suwa (JP); HOSOKAWA CORPORATION, Suwa (JP)

( * ) Notice: Subject to any disclaimer, the term of this patent is extended or adjusted under 35 U.S.C. 154(b) by 116 days.

(21) Appl. No.: 14/471,626

(22) Filed: Aug. 28, 2014

(65) Prior Publication Data

US 2015/0065404 A1 Mar. 5, 2015

(30) Foreign Application Priority Data

Aug. 28, 2013 (JP) ..... 2013-176793

(51) Int. Cl.
*C10M 119/02* (2006.01)
*C10M 107/04* (2006.01)
(Continued)

(52) U.S. Cl.
CPC ..... *C10M 169/06* (2013.01); *C10M 107/02* (2013.01); *C10M 117/04* (2013.01);
(Continued)

(58) Field of Classification Search
CPC ..... C10M 169/06; C10M 2207/1256; C10M 2205/0285; C10M 107/02; C10M 2205/0206; C10M 145/28; C10M 2209/104; C10M 2207/1285; C10M 117/04; C10M 145/00; C10M 119/02; C10M 119/04; C10N 2220/022; C10N 2230/06; C10N 2240/06; C10N 2250/10; C10N 2230/02; C10N 2020/00; C10N 2020/02; C10N 2020/04; C10N 2040/18; C10N 2050/10
(Continued)

(56) References Cited

U.S. PATENT DOCUMENTS

2007/0149422 A1* 6/2007 Miyajima ..... C10M 159/06 508/451
2008/0219610 A1* 9/2008 Nakatani ..... B60B 27/00 384/462

FOREIGN PATENT DOCUMENTS

JP 6-143775 5/1994
JP 61-143775 5/1994
(Continued)

OTHER PUBLICATIONS

Clariant Wax Catalog with Licowax PED 153.

*Primary Examiner* — Pamela H Weiss
(74) *Attorney, Agent, or Firm* — Nixon & Vanderhye P.C.

(57) ABSTRACT

The invention provides a grease composition for use in an image forming apparatus, containing a thickener, a base oil and a lubricity improver, wherein the thickener is a lithium soap, the base oil is a synthetic hydrocarbon oil, the lubricity improver is a polyethylene oxide wax, and the image forming apparatus is equipped with a sliding member and a member for holding the sliding member which is driven to slide through the holding member via the grease composition, one of the sliding member or the holding member for the sliding member having a sliding surface formed from a
(Continued)

metal, and the other having a sliding surface formed from a resin.

6 Claims, 1 Drawing Sheet

(51) Int. Cl.

| | |
|---|---|
| ***C10M 143/02*** | (2006.01) |
| ***C10M 145/28*** | (2006.01) |
| ***C10M 169/06*** | (2006.01) |
| *C10M 117/04* | (2006.01) |
| *C10M 107/02* | (2006.01) |

(52) U.S. Cl.
CPC ... *C10M 145/28* (2013.01); *C10M 2205/0206* (2013.01); *C10M 2205/0285* (2013.01); *C10M 2207/1256* (2013.01); *C10M 2207/1285* (2013.01); *C10M 2209/104* (2013.01); *C10N 2220/022* (2013.01); *C10N 2230/06* (2013.01); *C10N 2240/06* (2013.01); *C10N 2250/10* (2013.01)

(58) Field of Classification Search
USPC ..... 508/100
See application file for complete search history.

(56) References Cited

FOREIGN PATENT DOCUMENTS

| | | | |
|---|---|---|---|
| JP | 2003003185 A | * | 1/2003 |
| WO | WO 2004/081156 | | 9/2004 |

* cited by examiner

GREASE COMPOSITION FOR IMAGE FORMING APPARATUS AND IMAGE FORMING APPARATUS WITH GREASE COMPOSITION

The present application is based on and claims priority from Japanese Patent Application No. 2013-176793, filed on Aug. 28, 2013, the disclosure of which is incorporated herein by reference.

FIELD OF THE INVENTION

The present invention relates to a grease composition used for an image forming apparatus and an image forming apparatus with the above-mentioned grease composition.

BACKGROUND OF THE INVENTION

As one embodiment of the image forming apparatus, there is conventionally known a recording apparatus provided with a guide rail (i.e., a member for holding a sliding member), a carriage (i.e., the sliding member) that can freely slide along the guide rail in the axial direction thereof, and a printing head (i.e., a recording member) that is mounted on the carriage and driven to transfer ink from an ink ribbon to a recording medium, thereby accomplishing the recording operation (for example, as in JP (Hei) 06-143775 A).

In such an image forming apparatus, a ribbon cassette having therein both the ink ribbon and a greases retention member is usually attached to the carriage. Owing to the grease retention member, a grease is applied to the outer surface of the guide rail as the carriage is driven to slide along the guide rail, thereby reducing friction of the sliding carriage against the guide rail.

In practice, however, further decrease of the friction has been required from the viewpoints of saving resources and energy.

The carriage or the guide rail is typically made of resins with low friction resistance. However, those resins may be caused to deteriorate by prolonged contact with the grease that is less compatible with the resins. In light of this, the above-mentioned resins are also required to have improved durability.

SUMMARY OF INVENTION

Technical Problem

Accordingly, an object of the invention is to provide a grease composition used for an image forming apparatus, the grease composition exhibiting a lower coefficient of friction and more satisfactory compatibility with resin (that is, lower resin attack by the grease) than conventional grease compositions.

Solution to Problem

As a result of extensive studies to solve the problems, the inventors of the present invention found that the above-mentioned object can be achieved by using a grease composition which comprises a particular thickener, a particular base oil and a polyethylene oxide wax as a lubricity improver for an image forming apparatus employing a particular material. More specifically, the invention provides a grease composition and an image forming apparatus shown below.

1. A grease composition for use in an image forming apparatus, comprising a thickener, a base oil and a lubricity improver, wherein;

the thickener is a lithium soap, the base oil is a synthetic hydrocarbon oil, the lubricity improver is a polyethylene oxide wax, and the image forming apparatus comprises a sliding member and a member for holding the sliding member which is driven to slide through the holding member via the grease composition, one of the sliding member or the holding member for the sliding member having a sliding surface formed from a metal, and the other having a sliding surface formed from a resin.

2. The grease composition as described in the above-mentioned item 1, wherein the synthetic hydrocarbon oil has a kinematic viscosity of 5 to 30 $mm^2/s$ at 40° C.

3. The grease composition as described in the above-mentioned item 1 or 2, wherein the synthetic hydrocarbon oil is a poly-α-olefin.

4. The grease composition as described in any one of the above-mentioned items 1 to 3, wherein the lithium soap is selected from the group consisting of lithium 12-hydroxystearate, lithium stearate and mixtures thereof.

5. The grease composition as described in any one of the above-mentioned items 1 to 4, wherein the polyethylene oxide wax has a dropping point of 100 to 110° C.

6. The grease composition as described in any one of the above-mentioned items 1 to 5, wherein the polyethylene oxide wax is contained in an amount of 0.1 to 10 mass % based on the total mass of the grease composition.

7. The grease composition as described in any one of the above-mentioned items 1 to 6, wherein the metal is stainless steel electroplated with zinc and the resin is modified polyphenylene ether (modified PPE) or polyacetal (POM).

8. An image forming apparatus comprising a sliding member and a member for holding the sliding member which is driven to slide through the holding member via a grease composition comprising a thickener, a base oil and a lubricity improver, wherein;

the thickener is a lithium soap, the base oil is a synthetic hydrocarbon oil, the lubricity improver is a polyethylene oxide wax, and one of the sliding member or the holding member for the sliding member has a sliding surface formed from a metal, and the other has a sliding surface formed from a resin.

Effects of Invention

A grease composition according to the invention can further reduce the friction, and exhibit more satisfactory compatibility with the resin than conventional grease compositions for image forming apparatus. In addition, the grease composition of the invention is excellent in durability.

DETAILED DESCRIPTION OF THE INVENTION (Thickener)

Figure 1:
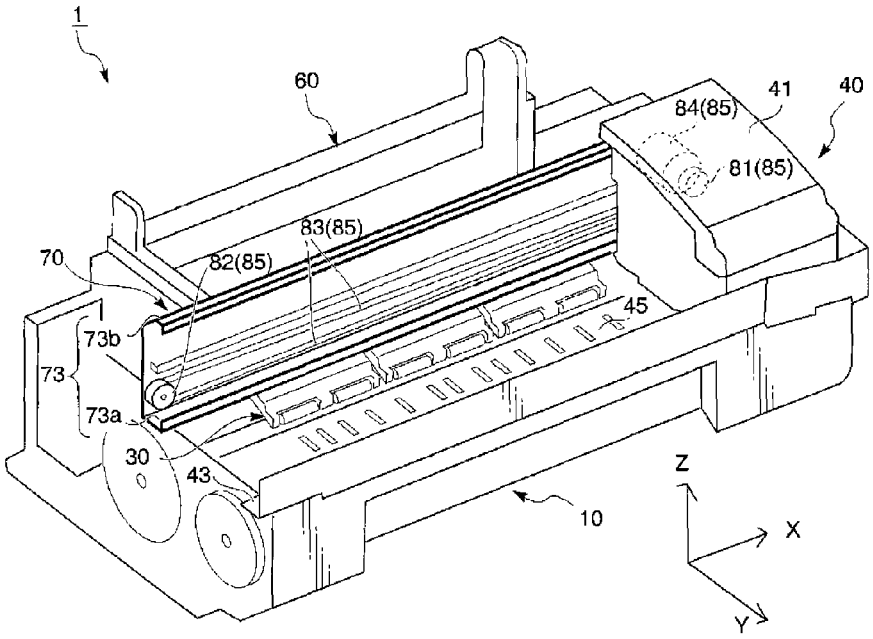
FIG. 1 is a perspective view showing one embodiment of an image forming apparatus according to the invention, with the cover removed.

The thickener of the grease composition according to the invention is a lithium soap. Examples of the lithium soap include lithium caproate, lithium caprylate, lithium caprate, lithium laurate, lithium myristate, lithium palmitate, lithium stearate, lithium 12-hydroxystearate, lithium oleate, lithium arachidate, lithium behenate and the like.

Preferably, the thickener may consist of lithium soap. Particularly, lithium 12-hydroxystearate and lithium stearate are preferred as the lithium soap. When lithium 12-hydroxystearate is used as the lithium soap, the lithium 12-hydroxystearate may preferably be used in combination with lithium stearate. In this case, the amount of lithium stearate may be smaller than that of lithium 12-hydroxystearate, for example, at a ratio by mass of lithium 12-hydroxystearate to lithium stearate of 9:1. Therefore, it is more preferable that the lithium soap consist of lithium 12-hydroxystearate alone, a mixture of lithium 12-hydroxystearate and lithium soap, or a mixture of lithium 12-hydroxystearate and lithium stearate.

The grease composition of the invention may preferably have a consistency of 320 to 340. A hard grease composition with extremely low consistency may increase the resistance to stirring, while a soft grease composition with extremely high consistency may cause leakage or oil separation due to lowered retention of oil component, which results in dropping of oil onto printing paper and oozing of oil. The content of the thickener should be adjusted to obtain the appropriate consistency as mentioned above. To be more specific, the content of the thickener may preferably be 2 to 20 mass %, and more preferably be 5 to 10 mass %, based on the total mass of the grease composition according to the invention.

(Base Oil)

The base oil of the grease composition according to the invention is a synthetic hydrocarbon oil. Examples of the synthetic hydrocarbon oil include poly-α-olefin (PAO), polybutene and the like.

Preferably, the base oil may consist of the synthetic hydrocarbon oil, more preferably PAO.

The base oil used in the invention may preferably have a kinematic viscosity at 40° C. of 2 to 50 $mm^2/s$, more preferably 5 to 30 $mm^2/s$, and most preferably 10 to 20 $mm^2/s$. Too low viscosity may unfavorably lead to insufficient lubricity, and extremely high viscosity may increase the resistance to stirring.

The base oil may be present in an amount of 80 to 93% by mass, preferably 85 to 93% by mass, more preferably 87 to 93% by mass based on the total mass of the grease composition.

(Lubricity Improver)

The grease composition of the invention comprises a polyethylene oxide wax as the lubricity improver.

The polyethylene oxide wax that can be used in the invention is not particularly limited, but may preferably have a weight-average molecular weight of 3,000 to 4,500. Too large molecular weight will significantly increase the melt viscosity, which makes homogeneous dispersion of the polyethylene oxide wax into the grease composition difficult. Consequently, a homogeneous grease composition cannot be obtained.

The polyethylene oxide wax used in the invention may preferably have an acid value of 10 to 40 mg KOH/g, and more preferably 15 to 28 mg KOH/g. Higher acid value means an increase of the number of polar groups in the wax, and shows better adsorption by plastic materials and more satisfactory lubricity. However, extremely high acid value may unfavorably be a cause of oxidative deterioration of grease.

The dropping point of the polyethylene oxide wax used in the invention may preferably be in the range of 100 to 115° C., more preferably 100 to 110° C., still more preferably 101 to 110° C., and most preferably 102 to 108° C.

The melt viscosity (120° C.) of the polyethylene oxide wax used in the invention may preferably be in the range of 100 to 500 mPa·s, and more preferably 300 to 350 mPa·s. Too low melt viscosity will result in insufficient lubricity, and too high melt viscosity will increase the resistance to stirring, and finally homogeneous dispersion may be difficult.

The polyethylene oxide wax used in the invention may preferably have a density of 0.90 to 1.00 $g/cm^3$.

A polyethylene oxide wax prepared in the presence of a Ziegler catalyst by the low-pressure polymerization process is preferably used in the invention. The polyethylene oxide wax prepared by the above-mentioned method shows a tendency of straight-chain with less branches when compared with those prepared by the high-pressure polymerization process.

The content of the polyethylene oxide wax may preferably be in the range of 0.01 to 20 mass %, and more preferably 0.1 to 10 mass %, based on the total mass of the grease composition according to the invention. Too small amount of polyethylene oxide wax will result in insufficient lubricity, and too large amount may increase the resistance to stirring.

(Further Additives)

When necessary, the grease composition of the invention may further comprise additives generally used in the conventional grease compositions, for example, an antioxidant, a metal passivator, a rust preventive and the like. The content of the additive is generally in the range of 0.01 to 10 mass %.

The antioxidant includes phenol-based antioxidants and amine-based antioxidants.

Examples of the phenol-based antioxidants include 2,6-di-t-butyl-p-cresol (BHT), 2,2'-methylenebis(4-methyl-6-t-butylphenol), 4,4'-butylidenebis(3-methyl-6-t-butyl-phenol), 2,6-di-t-butyl-phenol, 2,4-dimethyl-6-t-butylphenol, t-butylhydroxyanisole (BHA), 4,4'-butylidenebis(3-methyl-6-t-butylphenol), 4,4'-methylenebis(2,3-di-t-butyl-phenol), and 4,4'-thiobis(3-methyl-6-t-butylphenol).

Examples of the amine-based antioxidants include N-n-butyl-p-aminophenol, 4,4'-tetramethyl-di-aminodiphenylmethane, α-naphthylamine, N-phenyl-α-naphthyl amine, and phenothiazine.

Examples of the metal passivator include benzotriazole, 1,2,4-triazole, benzimidazole, 2-alkylthiobenzimidazole and derivatives of 2-alkylthiobenzimidazole.

The rust preventive includes inorganic and organic rust preventives. Examples of the inorganic rust preventive include inorganic metallic salts such as sodium silicate, sodium nitrite, sodium molybdate, lithium carbonate, and potassium carbonate. Examples of the organic rust preventive include benzoates such as sodium benzoate, lithium benzoate and the like, suifonates such as calcium sulfonate, zinc sulfonate and the like, carboxylates such as zinc naphthenate, sodium sebacate and the like, succinic acid and derivatives thereof such as succinic anhydride, succinic acid half-ester and the like, sorbitan esters such as sorbitan monooleate, sorbitan trioleate and the like, and fatty acid amine salts.

It is preferable that the grease composition of the invention consist essentially of a mixture of lithium 12-hydroxystearate and lithium stearate; a PAO with a kinematic viscosity at 40° C. of 2 to 50 $mm^2/s$; a polyethylene oxide wax with a dropping point of 100 to 115° C.; a phenol-based antioxidant; and a metal passivator.

It is more preferable that the grease composition of the invention consist essentially of a mixture of lithium 12-hydroxystearate and lithium stearate; a PAO with a kinematic viscosity at 40° C. of 5 to 30 $mm^2/s$; a polyethylene oxide wax with a dropping point of 100 to 115° C.; a phenol-based antioxidant; and a metal passivator.

It is particularly preferable that the grease composition of the invention consist essentially of 5 to 10 mass % of a mixture of lithium 12-hydroxystearate and lithium stearate with a ratio by mass of 9:1; 87 to 93 mass % of a PAO with a kinematic viscosity at 40° C. of 10 to 20 $mm^2/s$; 0.1 to 10 mass % of a polyethylene oxide wax with a dropping point of 101 to 110° C.; 0.01 to 10 mass % of a phenol-based antioxidant; and 0.01 to 10 mass % of a metal passivator.

(Image Forming Apparatus)

An image forming apparatus according to the invention is provided with a sliding member and a member for holding the sliding member which is driven to slide through the holding member via a grease composition, wherein one of the sliding member or the member for holding the sliding member has a sliding surface formed from a metal, and the other has a sliding surface formed from a resin. One sliding member may have two or more sliding surfaces. The shape of the sliding surfaces of the sliding member and the member for holding the sliding member is not limited to a plane.

The embodiments of the invention will now be explained more specifically by referring now in detail to the drawings.

Figure 2:
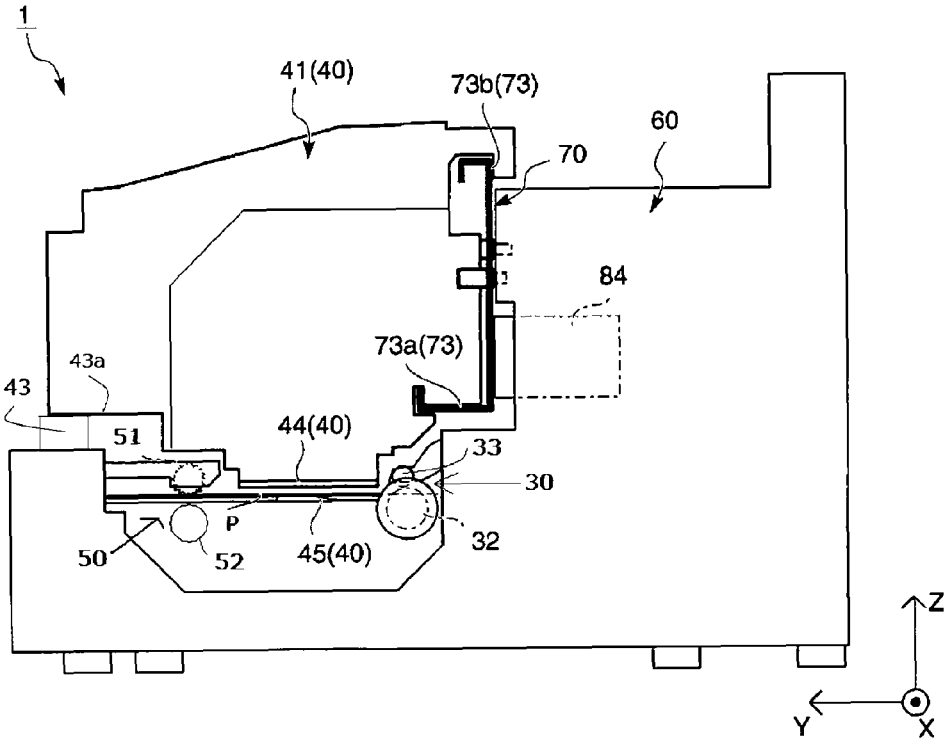
FIG. 2 is a vertical sectional view taken on plane Z-Y, showing the inside of the image forming apparatus according to one embodiment of the invention.

FIG. 1 is a perspective view schematically showing the outline of a recording apparatus, i.e., an ink-jet printer 1 (hereinafter also referred to as a printer). The ink-jet printer is one example of the image forming apparatus of a liquid-jetting type according to the invention. FIG. 2 is a vertical sectional view taken on plane Z-Y, showing the inside of the printer according to one embodiment of the invention.

The image forming apparatus of a liquid-jetting type herein used means not only the ink-jet recording apparatus, copying apparatus, facsimile apparatus and the like designed to achieve recording operation by driving a printing head, i.e., a liquid-jetting head, to jet a liquid ink onto an image receiving medium such as recording paper, but also any other apparatus designed to eject a liquid according to the particular purpose from the liquid-jetting head onto a medium receiving a jet of liquid and attach the liquid to the medium.

In addition to the recording head as mentioned above, the liquid-jetting head includes a head for ejecting a coloring material for manufacturing the color filters for liquid crystal display and the like, a head for ejecting an electrode material (i.e., electroconductive paste) for forming the electrodes of organic EL display, field emission display (FED) and the like, a head for ejecting a bioorganic substance for manufacturing the biochip, a head for ejecting a sample used in a precision pipette, and the like.

As shown in FIGS. 1 and 2, a printer 1 is provided with a paper cassette 10, a paper feeding unit (not shown), a transporting unit 30, a recording unit 40 and a discharging unit 50. The paper cassette 10 which is disposed at a lower part of the printer 1 holds a stack of paper (P). A sheet of paper P stacked on the paper cassette 10 is picked up by the paper feeding unit (not shown) and guided along a paper feeding route (not shown) to the transporting unit 30 disposed downstream in the paper feeding direction.

The transporting unit (30) comprises a transport driving roller 32 powered by a motor (not shown) and a transport driven roller 33 that is operated by the roller 32, to transport the paper (P) to the recording unit 40 with high accuracy.

The recording unit 40 is designed to achieve the recording operation by ejecting ink onto the paper (P) transported from the transporting unit 30. More specifically, the recording unit 40 is provided with a carriage 41 formed from metal plates or resin plates, a recording head 44, a first guide rail portion 73 formed from metal plates or resin plates, a second guide rail portion 43 formed from metal plates or resin plates, which is located on the opposite side of the recording head 44 from the first guide rail portion 73, and a paper support 45. The carriage 41 is driven by a carriage motor 84 to move reciprocatingly in a paper width direction (X) as being guided by the first guide rail portion 73 and the second guide rail portion 43 extended in the paper width direction (X). The recording head 44 is disposed at the lower part of the carriage 41 to eject ink onto the paper (P). The paper support 45 is disposed opposite to the recording head to support the paper (P) from the rear side thereof.

Referring to FIG. 2, the first guide rail portion 73 forms a part of a frame unit 70 made from metal plates or resin plates. Specifically, the first guide rail portion 73 has a first sliding surface 73*a* and a second sliding surface 73*b* for letting the carriage 41 slide through. The second guide rail portion 43 has a third sliding surface 43*a* for letting the carriage 41 slide through.

The paper support 45 is formed on a part of a base unit 60 made of resin materials such as plastics and the like. The frame unit 70 is attached to the base unit 60.

The carriage 41 may come in a sliding contact with only two surfaces, i.e., the first sliding surface 73*a* and the second sliding surface 73*b*, or the first sliding surface 73*a* and the third sliding surface 43*a*.

As shown in FIG. 1, the frame unit 70 is equipped with a driving means 85 for running the carriage 41, comprising a carriage motor 84, a driving pulley 81, a driven pulley 82 and an endless belt 83. The carriage motor 84 is operated to drive the driving pulley 81 which is disposed at one end of the frame unit 70 in the paper width direction (X).

The driven pulley 82 is located at the opposite end in the paper width direction (X) of the frame unit 70. The endless belt 83 is wound around the driving pulley 81 and the driven pulley 82. Part of the endless belt 83 is engaged with the carriage 41, so that a power can be transmitted to the carriage 41 via the endless belt 83 when the carriage motor 84 is driven. This can thus move the carriage 41 in the paper width direction (X) as being guided through the first guide rail portion 73 and the second guide rail portion 43.

The discharging unit 50 is arranged so as to discharge the paper (P) to a discharge tray (not shown) placed outside the printer 1 after the paper (P) has been subjected to the recording operation in the recording unit 40. To be more specific, the discharging unit 50 is provided with a discharge driving roller 51 and a discharge supporting roller 52, and operated in such a manner that power of a motor for transport (not shown) is transmitted to the discharge driving roller 51 through a power transmission means (not shown).

The grease composition of the invention is applied to the first sliding surface 73*a*, the second sliding surface 73*b* and the third sliding surface 43*a* which are brought in a sliding contact with the carriage 41 for the purpose of improving the sliding properties of the carriage 41 with respect to the first guide rail portion 73 and the second guide rail portion 43.

Examples of the metal constituting the carriage 41, the first guide rail portion 73 and the second guide rail portion 43 include stainless steel electroplated with zinc, stainless steel, free-cutting steel and the like. In particular, the zinc electroplated steel is preferred because of the reasonable price and the high degree of freedom in shape.

Examples of the resin constituting the carriage 41, the first guide rail portion 73 and the second guide rail portion 43 include acrylonitrile-butadiene-styrene resin (ABS), polycarbonate (PC), modified polyphenylene ether (modified PPE), polyacetal (POM), polystyrene (PS) and the like. In particular, modified polyphenylene ether is advantageous in terms of the resistance to grease (oil resistance) and the rigidity; and polyacetal (POM) is also advantageous in consideration of the resistance to grease (oil resistance) and the resultant sliding properties.

Particularly preferable is zinc electroplated steel as the above-mentioned metal, and modified polyphenylene ether (modified PPE) or polyacetal (POM) as the above-mentioned resin.

EXAMPLES

Preparation of Sample Grease Compositions

Examples 1 to 4 and Comparative Examples 2 to 4

Lithium 12-hydroxystearate and lithium stearate were mixed in a base oil and dissolved therein under application of heat thereto. The resultant mixture was cooled to obtain a base grease. In another vessel, a predetermined amount of a polyethylene oxide wax was mixed into a base oil, and the resultant mixture was added to the above-mentioned base grease, followed by sufficient stirring. Using a three-roll mill, the mixture was kneaded and adjusted to have a worked penetration of 330, thereby obtaining a grease composition.

Comparative Example 1

Isocyanate was allowed to react with amine in a base oil, to obtain a base grease. The base grease thus obtained was subjected to the same procedures as mentioned above, so that a grease composition was obtained.

The kinematic viscosity of the base oil at 40° C. was determined in accordance with HS K 2220 23. The worked penetration of the grease composition was determined in accordance with JIS K 2220 7.

Test Methods

Coefficient of Friction

TE77 Friction Test
(Test Conditions)

Test pieces: A material for bush; finished by surface grinder TR20 (dia. 12)

Plate: Stainless steel plate electroplated with zinc (with a surface roughness Ra of 0.1 μm Load: 226 N
Stroke: 15 mm
Frequency: 33.9 Hz
Sliding rate: 1019 mm/s
Test temperature: Room temperature
Test duration: 10 minutes
Measuring item: Coefficient of friction (average taken in the last one minute)

The evaluation criteria of coefficient of friction were as follows:

less than 0.05: good=o
0.05 or more: not good=x

Resistance to Resin

Resin bending test (to evaluate the stress crack of resin caused by application of grease)

A bending stress was given to the center of an ABS resin sample plate (6.35 mm×12.7 mm×127 mm) to have a displacement of 3 mm. The resultant convex portion of the resin plate was coated with a sample grease composition. Subsequently, the grease-coated resin plate was allowed to stand at 80° C. for 4 hours. Four hours later, the presence of breaking, crack, crazing and the like was observed.

The evaluation criteria were as follows:

o: No change
Δ: Tendency of whitening or fine crazing
x: Cracks or breaking

The results are shown in Table 1.

TABLE 1

| | | Ex. 1 | Ex. 2 | Ex. 3 | Ex. 4 | Comp. Ex. 1 | Comp. Ex. 2 | Comp. Ex. 3 | Comp. Ex. 4 |
|---|---|---|---|---|---|---|---|---|---|
| Thickener (mass %) | Lithium soap | 6.6 | 5.7 | 5.4 | 5.7 | | 5.7 | 5.7 | 6.8 |
| | Aliphatic diurea | | | | | 6.5 | | | |
| Base Oil | Synthetic hydrocarbon oil A | Balance | Balance | | Balance | Balance | | Balance | Balance |
| | Synthetic hydrocarbon oil B | | | Balance | | | | | |
| | Ester oil | | | | | | Balance | | |
| Wax (mass %) | Polyethylene oxide wax A | 1.0 | 3.0 | 3.0 | | 3.0 | 3.0 | | |
| | Polyethylene oxide wax B | | | | 3.0 | | | | |
| | polyethylene wax | | | | | | | 3.0 | |
| Evaluation | Coefficient of friction (○: <0.05 X: ≥0.05) | ○ | ○ | ○ | ○ | X | ○ | X | X |
| | Resistance to resin | ○ | ○ | ○ | ○ | ○ | X | ○ | ○ |

Lithium soap: Lithium 12-hydroxystearate + Lithium stearate (ratio by mass = 9:1)
Aliphatic diurea: reaction product of diphenylamine diisocyanate with stearylamine (molar ratio = 1:2)
Synthetic hydrocarbon oil A: PAO with a kinematic viscosity at 40° C. of 17.5 mm2/s
Synthetic hydrocarbon oil B: PAO with a kinematic viscosity at 40° C. of 30.5 mm2/s
Ester oil with a kinematic viscosity at 40° C. of 17.5 mm2/s
Polyethylene oxide wax A: Licowax PED 522, made by Clariant K.K.
Polyethylene oxide wax B: Licowax PED 521, made by Clariant K.K.
Polyethylene wax: Licowax PE 190 made by Clariant K.K.

What is claimed is:

1. A grease composition, comprising a thickener, a base oil and a lubricity improver, wherein;

the thickener is a lithium soap, the base oil is a synthetic hydrocarbon oil, the lubricity improver is a polyethylene oxide wax having a melt viscosity of 100 to 500 mPa·s, at 120° C., and wherein the polyethylene oxide wax has a dropping point of 100° C. to 110° C. and wherein the polyethylene oxide wax has an acid value of 10 to 40 mgKOH/g, and the synthetic hydrocarbon oil has a kinematic viscosity of 5 to 30 $mm^2/s$ at 40° C.

2. The grease composition of claim 1, wherein the synthetic hydrocarbon oil is a poly-α-olefin.

3. The grease composition of claim 1, wherein the lithium soap is selected from the group consisting of lithium 12-hydroxystearate, lithium stearate and mixtures thereof.

4. The grease composition of claim 1, wherein the polyethylene oxide wax is contained in an amount of 0.1 to 10 mass % based on the total mass of the grease composition.

5. An image forming apparatus comprising a sliding member and a member for holding the sliding member which is driven to slide through the holding member via a grease composition comprising a thickener, a base oil and a lubricity improver, wherein;

the thickener is a lithium soap, the base oil is a synthetic hydrocarbon oil, the synthetic hydrocarbon oil has a kinematic viscosity of 5 to 30 $mm^2/s$ at 40° C., the lubricity improver is a polyethylene oxide wax having a melt viscosity of 100 to 500 mPa·s at 120° C. and wherein the polyethylene oxide wax has a dropping point of 100° C. to 110° C. and wherein the polyethylene oxide wax has an acid value of 10 to 40 mgKOH/g, and one of the sliding member or the holding member for the sliding member has a sliding surface formed from a metal, and the other has a sliding surface formed from a resin.

6. The grease composition of claim 1, wherein the polyethylene oxide has an acid value of 15 to 28 mgKOH/g.

* * * * *